US007421937B1

(12) United States Patent
Gangl

(10) Patent No.: US 7,421,937 B1
(45) Date of Patent: Sep. 9, 2008

(54) MODULAR INSERTION TRIGGER METHOD AND APPARATUS

(76) Inventor: John Gangl, P.O. Box 378, Hugo, MN (US) 55038

( * ) Notice: Subject to any disclaimer, the term of this patent is extended or adjusted under 35 U.S.C. 154(b) by 496 days.

(21) Appl. No.: 11/073,302

(22) Filed: Mar. 4, 2005

Related U.S. Application Data

(60) Provisional application No. 60/550,383, filed on Mar. 5, 2004.

(51) Int. Cl.
*F41A 19/16* (2006.01)

(52) U.S. Cl. ..... 89/142; 89/136; 89/148; 42/69.03

(58) Field of Classification Search ..... 89/136, 89/140, 142, 148, 149, 150, 154; 42/69.03
See application file for complete search history.

(56) References Cited

U.S. PATENT DOCUMENTS 2,549,904 A * 4/1951 Hoard ..... 42/69.02
3,292,492 A * 12/1966 Sturtevant ..... 89/128
3,755,951 A 9/1973 Koon, Jr.
3,950,876 A 4/1976 Wild et al.
4,671,005 A 6/1987 Jewell
5,012,604 A 5/1991 Rogers
5,487,233 A 1/1996 Jewell
5,623,114 A * 4/1997 Soper ..... 89/141
5,857,280 A 1/1999 Jewell
5,881,485 A 3/1999 Milazzo
5,924,231 A 7/1999 Kidd
6,131,324 A 10/2000 Jewell
6,681,511 B1 1/2004 Huber
6,772,548 B1 * 8/2004 Power ..... 42/69.03

* cited by examiner

*Primary Examiner*—Stephen M Johnson
(74) *Attorney, Agent, or Firm*—Michael F. Hughes; Hughes Law Firm, PLLC

(57) ABSTRACT

A trigger assembly comprising a housing adapted to mount a trigger, hammer and sear therein. The housing has an adjustment feature adapted to fixedly mount the housing within the trigger chamber portion of the firearm. The trigger assembly is particularly conducive for an AR-15 type rifle and the various sear engagement surfaces are adapted to be adjustable irrespective of the various dimensions and tolerances of the underlying firearm. A safety system is employed that adjustably allows proper engagement of the trigger tail to properly engage and disengage the safety mechanism.

15 Claims, 16 Drawing Sheets

39
38
22
186
44
20
37
42
54
24
105
202
156
140
32
119
152
46
113
142
112
41
26
56
21
61
28
150
57
154
70
60
73

MODULAR INSERTION TRIGGER METHOD AND APPARATUS

RELATED APPLICATIONS

This application claims priority benefit of U.S. Ser. No. 60/550,383, filed Mar. 5, 2004.

BACKGROUND OF THE DISCLOSURE

The apparatus relates to aftermarket (as well as OEM) trigger assemblies that are particularly adapted to be mounted in firearms. Specifically, in one form the apparatus is adapted to be retrofitted or initially installed to an AR-15 semiautomatic rifle.

After market triggers have been provided for rifles to replace factory trigger assemblies. Factory trigger assemblies are notoriously poor where a shooter's accuracy is compromised where the trigger has excessive over travel (where the trigger will travel excessive rearwardly after releasing a hammer) or have what is referred to as take up. Take up is an undesirable movement of the trigger prior to releasing the hammer.

In general, most shooters find it desirable when a trigger breaks like a "glass rod". In some military applications the trigger pull is up to 12 lbs. It is desirable lighten this trigger pull for a more accurate placement of a shot without undesirably altering the rifles position when pulling the trigger.

One challenge with aftermarket triggers is providing a suitably adjustable trigger that requires very little end-user involvement to retrofit to their existing lower receiver of an AR-15. In general, certain prior art methods of providing an adjustable trigger required employing setscrews where the end surface of the screw applies a pressure upon the lower surface in the cavity region with the trigger assembly is housed. Of course the relationships between the laterally extending pins and the upper surface of this chamber region can vary between firearms where an adjustable assembly of setscrews must be provided. A challenge to providing this adjustability is the end-user or installer of the aftermarket trigger assembly must manually adjust the setscrews and use a proper thread locking compound to ensure the screws do not change. The problems are further compounded where certain lower receivers are made from nonmetallic materials and the setscrews can wear out holes and change the various relationships of the dimensions between the laterally extending pins and the engagement surfaces provided for the setscrews. This possibly could change the action of the trigger overtime and potentially present a hazardous condition where the trigger may accidentally misfire. Of course, the problem of having the installer who may not be familiar with the process presents an opportunity for disaster if a prior art aftermarket trigger is not adjusted properly. For example, the geometries and orientations of the sear engagement surfaces between the disconnector and the hammer could be improper whereby misfire would occur with a certain vector acceleration of the firearm.

SUMMARY OF THE DISCLOSURE

The disclosure below discloses a trigger assembly adapted to be fitted to the lower receiver of a firearm having a central chamber region having a lower surface. The trigger assembly has a housing having a forward and rearward region and first and second lateral walls and a base portion having an upper surface. There is a locking system having an extendable member such as a set screw in one form that is adapted to engage the lower receiver to minimize movement between the housing and the lower receiver. A hammer is pivotally connected to the housing in the forward region of the housing. The hammer has a hammer disconnector sear surface. There is a trigger pivotally connected to the housing, the trigger has a trigger sear surface located in a forward region. A trigger over travel adjustment system having an adjustment number with a lower surface adapted to engage the upper surface of the housing to limit the range of rotational travel of the trigger in a first rotational direction.

A trigger take up adjustment system is provided having an adjustment member with a lower surface that is adapted to engage the upper surface of the housing to limit the amount of rotation of the trigger in a second rotational direction, the trigger further having a safety engagement surface.

A safety system comprising a laterally extending member and an adjustable member having a safety surface that is adapted to reposition with respect to the laterally extending member. The adjustment surface is adapted to engage the safety engagement surface of the trigger to limit rotation in a first rotational direction.

DETAILED DESCRIPTION OF THE PREFERRED EMBODIMENTS

Figure 1:
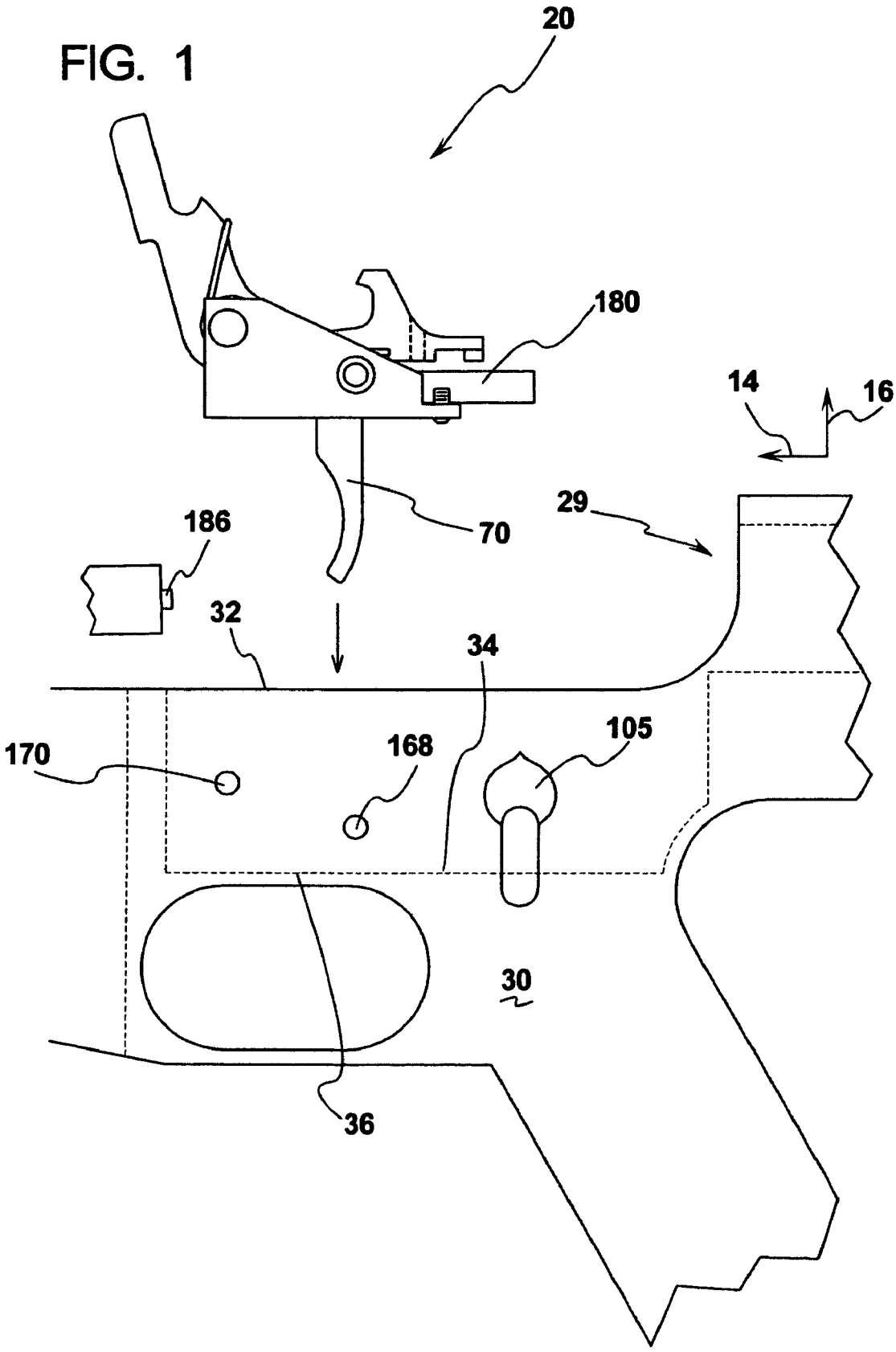
FIG. 1 shows a side view of the lower receiver of a firearm such as an AR-15 where the trigger assembly is positioned thereabove.

As shown in FIG. 1, there is a cross sectional side view of a trigger assembly 20 mounted within a lower receiver 30 of a 29 firearm. In one form, the firearm 29 is an AR-15 semi-automatic rifle. The lower receiver 30 comprises a central chamber area 32 having a lower support surface 34. The lower support surface 34 provides an opening 36 as adapted to allow the trigger extension 70 pass therethrough.

Figure 2:
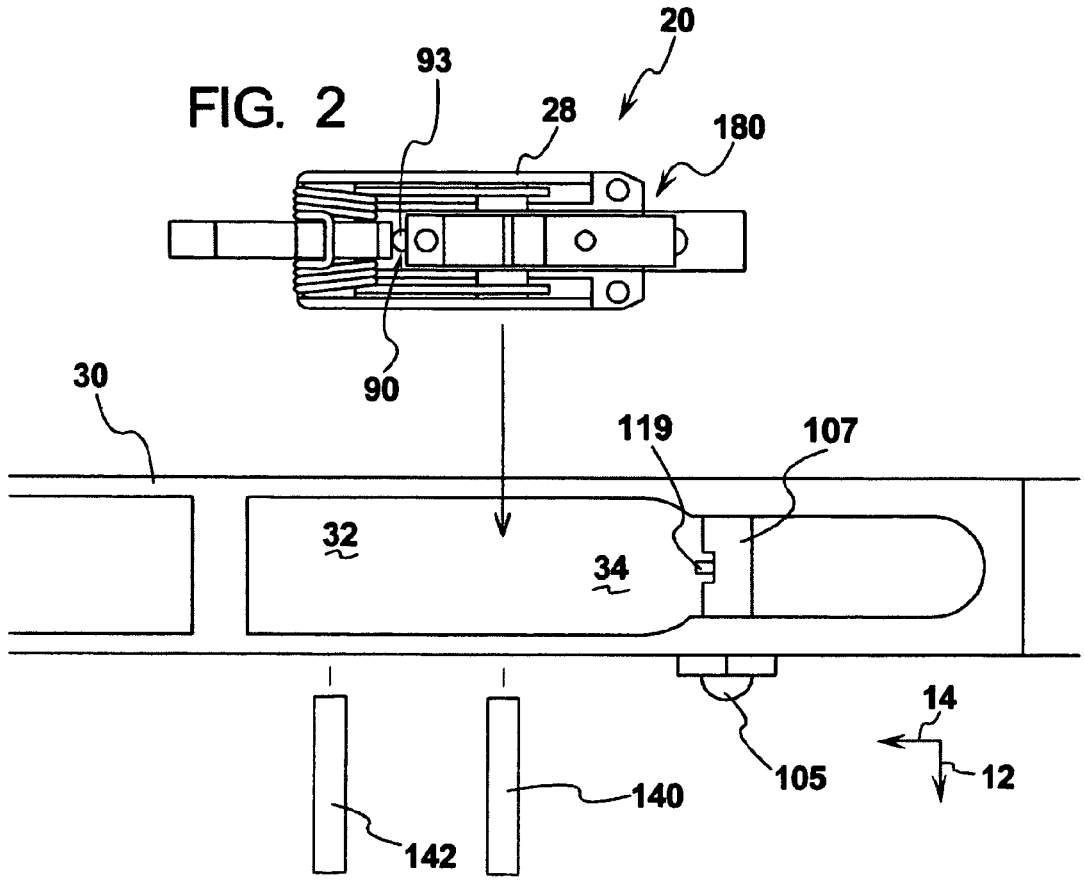
FIG. 2 is a top view of the lower receiver where one form of the invention is shown where laterally extending pins are schematically shown in the lower portion (and which oftentimes are integral with the lower receiver) and are adapted to hold the trigger assembly therein.

To aid the description of the invention, an axis system is defined that is shown in FIGS. 1 and 2 where the arrow 12 indicates a lateral direction, the arrow 14 indicates a longitudinal direction and the arrow 16 represents a transverse direction. Of course the trigger assembly 20 and the rifle can be positioned in various orientations and the axis system is provided for general purposes of describing the orientation of the components of the trigger assembly and not intended to limit the trigger assembly 20 to any specific orientation.

Figure 4:
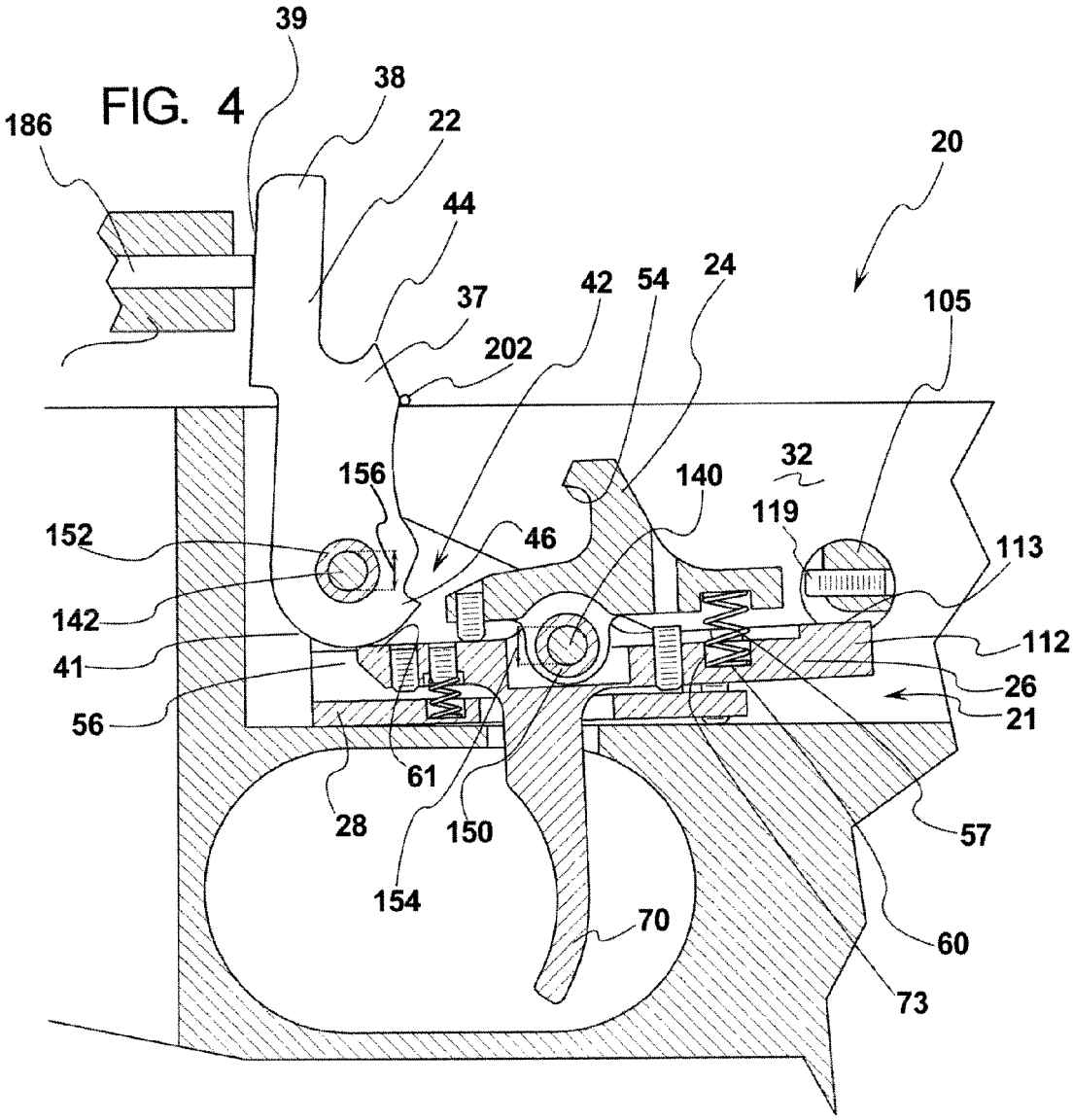
FIG. 4 is a cross-sectional view of the lower receiver and trigger assembly where the trigger assembly is in a low potential energy state and the hammer is down.

In general, as shown in FIG. 4 the trigger assembly 20 comprises a hammer 22, a sear disconnector 24, a trigger 26 and a housing 28. The hammer 22 comprises a firing pin engagement surface 39, an upper section 38, a central portion 37 and a pivot region 40. Further, the hammer 22 near the pivot region portion 40 comprises a portion of the hammer-trigger sear system 42 shown in various orientations in FIGS. 4-11 where a hammer disconnect sear surface 46 is located near the pivot region of the hammer 22 and cooperates with the trigger sear surface 56 described further below to maintain the hammer 22 in a cocked position.

The sear disconnector 24 comprises a pivot region 50, a hammer-disconnector sear system 52 and a biasing member 57. The pivot region 50 is adapted to be pivotally connected to the trigger 26 which are both in turn connected to the housing 28 described further herein.

As shown in FIG. 4, the sear disconnector 24 has a hammer-disconnector sear system 52 comprises two sets of sear surfaces. In general, the hammer-disconnector sear system 52 comprises an engagement sear surface 54 and the hammer engagement sear surface 44 discussed above. As further described below the basic function of the hammer-disconnector sear system 52 is to prevent the hammer 22 from following the firing pin after a shot is fired and if the trigger is positioned in the rearward direction. In other words, the hammer-trigger sear system 42 and the hammer-disconnector sear system 52 cooperate together where the surfaces 44 and 54 are adapted to engage one another in operation of the firearm to prevent full automatic fire or a second shot fired after an initial shot. Further, the surfaces 46 and 56 are adapted to engage one another to maintain the trigger in a cocked position as shown in the right hand portion of FIG. 9 and to release the hammer when the trigger extension 70 is pressed longitudinally rearwardly as indicated force vector 69.

Therefore, the hammer-trigger sear system 42 and the hammer-disconnector sear system 52 are collectively referred to as the sear system assembly. The sear system assembly has various widths in the lateral direction to provide longevity of the trigger assembly 20. The lateral widths do not need to be the same for the hammer-trigger sear system 42 and the hammer-disconnector sear system 52. The width can range between 100 thousands to 300 thousands in general.

The biasing member 57 in one form is a common metallic helical spring that is positioned longitudinally rearward with respect to the pivot region 50 to provide a counter clockwise moment about the pivot region 50 with respect to the view as shown in FIG. 4. The biasing member 57 comprises a lower surface 60 that is adapted to engage the upper surface 73 of the trigger tail portion 112 described below.

Figure 5:
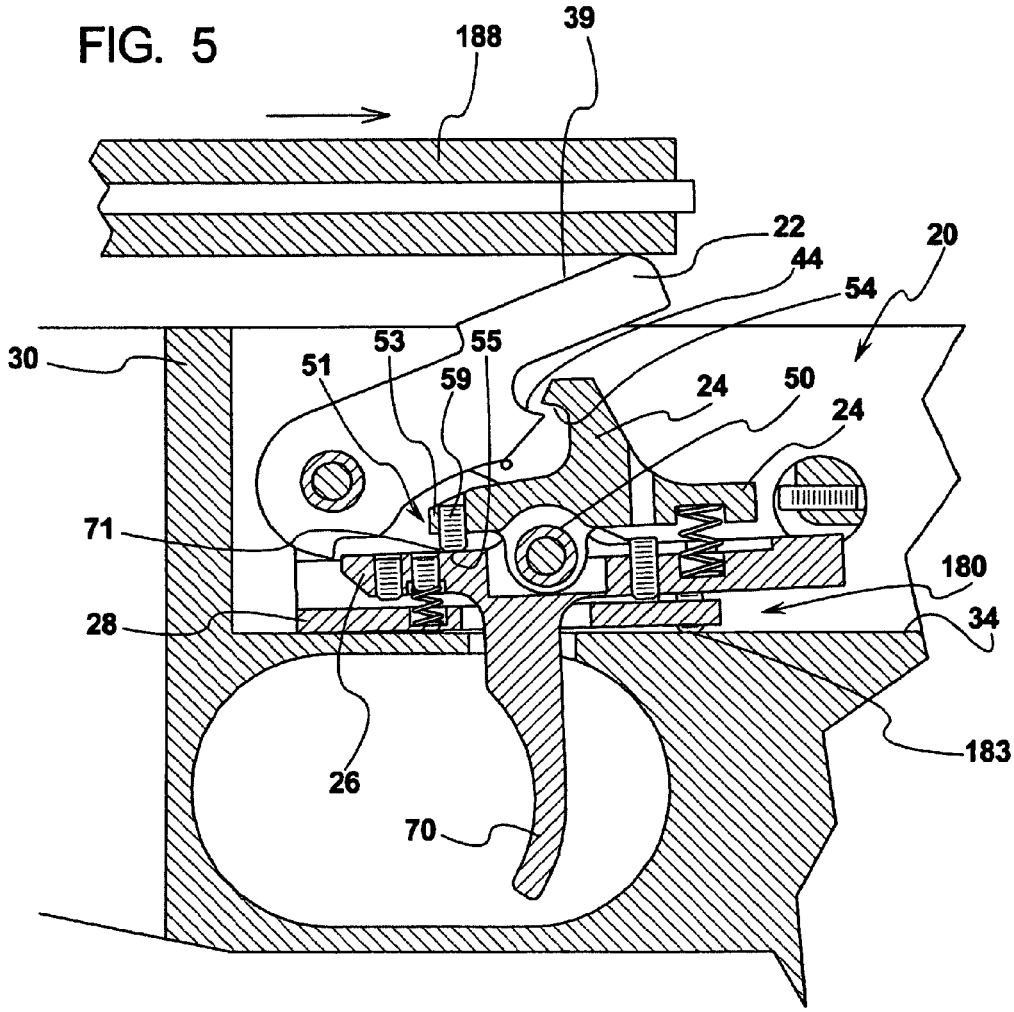
FIG. 5 shows the carriage assembly moving rearwardly to rotate the hammer in a clockwise direction.
Figure 7:
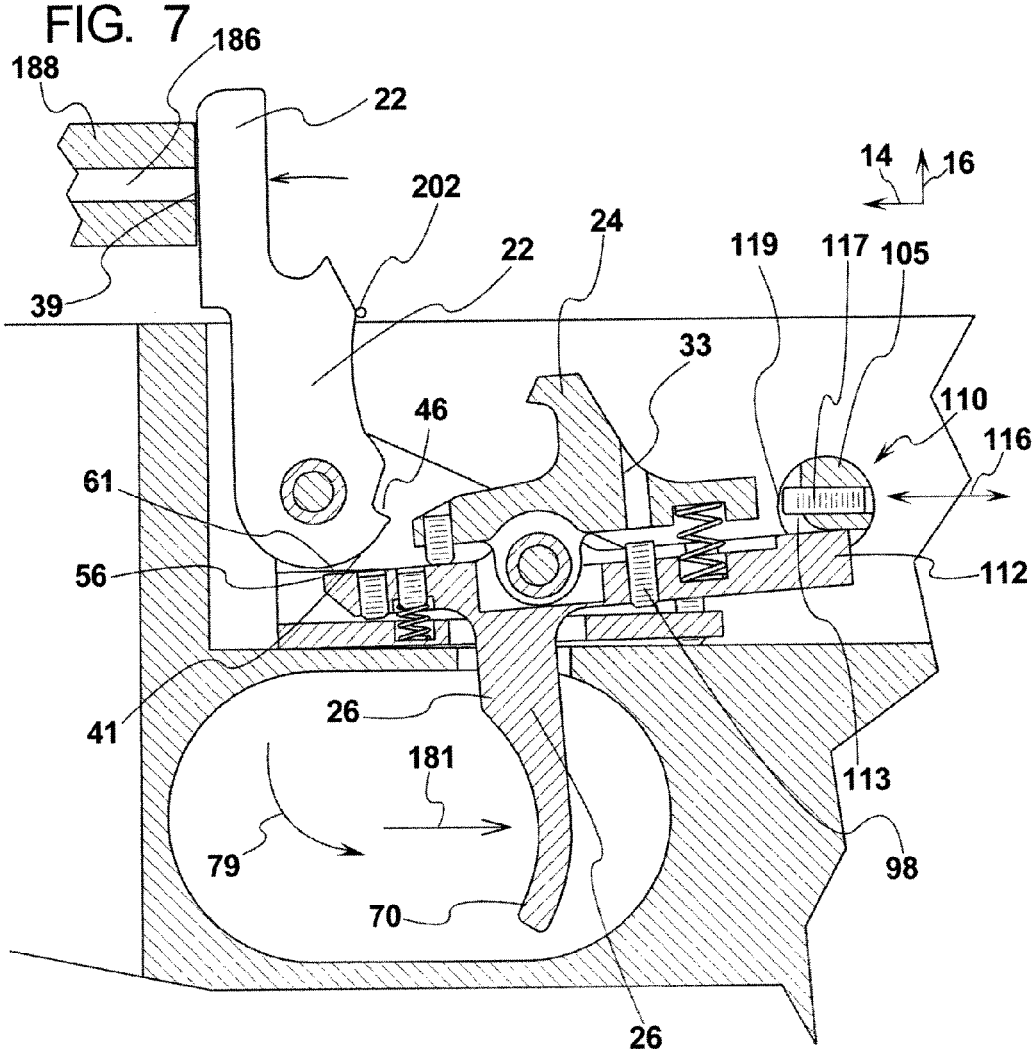
FIG. 7 shows the hammer falling where rearward travel of the trigger extension portion of the trigger disengages the sear surfaces between the trigger and the hammer and a moment upon the trigger spring imparts kinetic energy upon the firing pin of the carriage assembly to fire around.

As shown in FIG. 5, the sear disconnector 24 further comprises a disconnector adjustment system 51. In one form, the disconnector adjustment system 51 has a setscrew 59 that is adapted to be received in a threaded recessed region 53 of the longitudinally forward region of the sear disconnector 24. The upper open region of the recessed region 53 is adapted to have a wrench like device such as a hex screw to extend therein to adjust the setscrew 59. The bottom surface 55 of the setscrew is adapted to engage the upper surface 71 of the trigger 26 described further below. Essentially, the disconnector adjustment system 51 will make slight rotations about the pivot region 50 whereby the surfaces 54 and 44 will engage at various distances therefrom to give a proper disconnection therein between when the trigger is released after a proper full follow-through pull of the trigger by a shooter. The disconnector adjustment system 51 allows for adjustment of the position of the trigger 26 for releasing the hammer when the hammer release sear system is engaged and to adjust this system the installer does not need to remove metal from the surfaces 44 or 54. The disconnector 24 as shown in FIG. 7 further comprises a surface defining an opening 33 that provides access to the cents to 98 of the trigger take up adjustment system.

Figure 6:
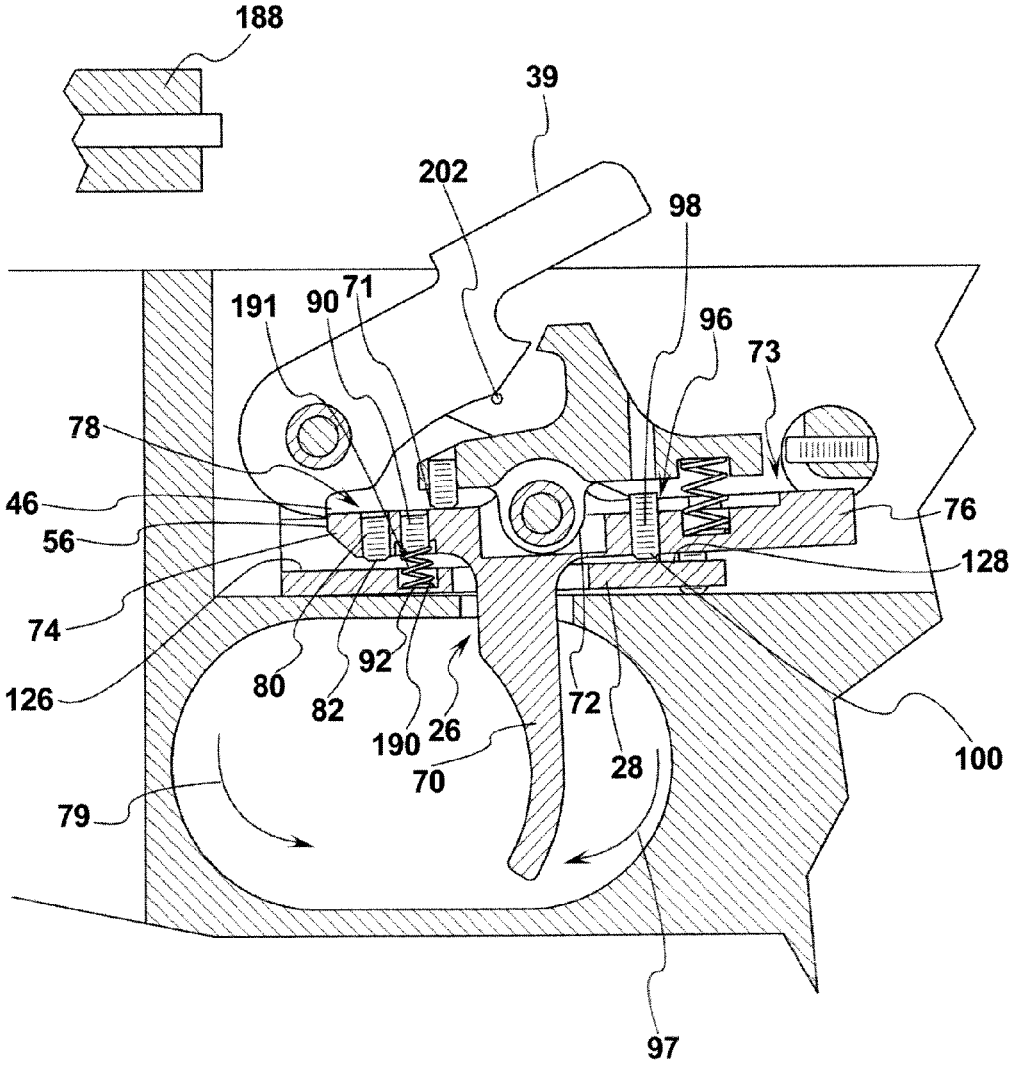
FIG. 6 shows the sear surfaces of the hammer and the trigger engaging one another so the hammer is in a retracted high potential energy state.
Figure 13A:
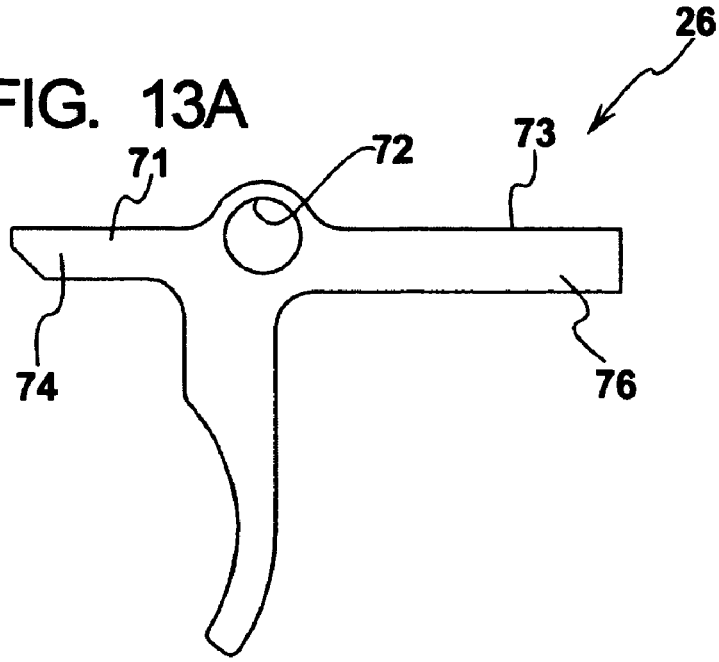
FIG. 13A shows a side view of the trigger assembly.
Figure 13B:
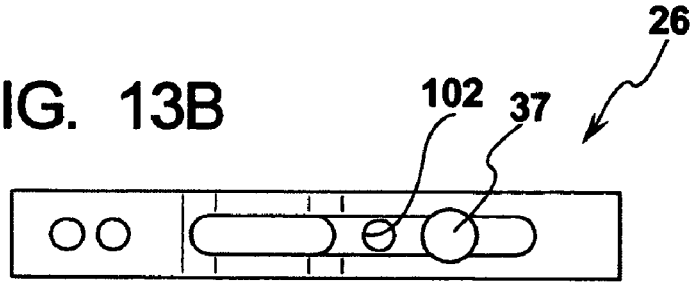
FIG. 13B shows a top view of the trigger.
Figure 13C:
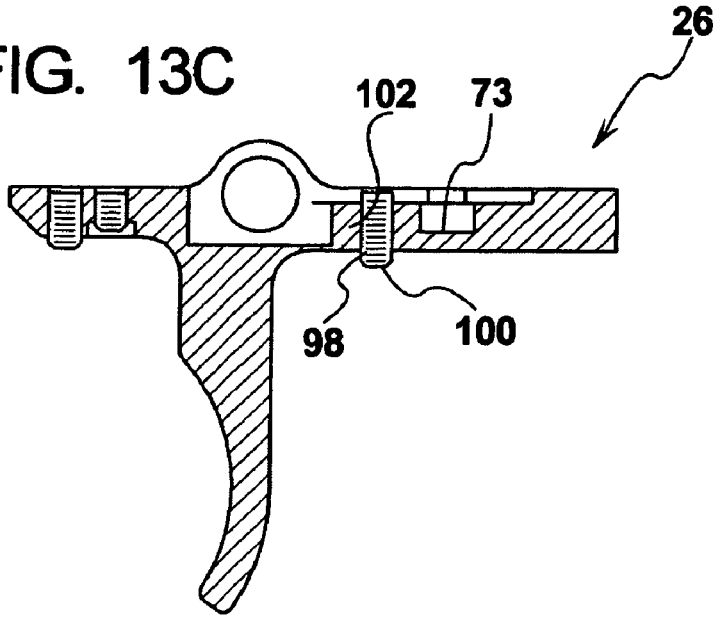
FIG. 13C shows a cross-sectional view of the trigger illustrating various adjustment features thereof.
Figure 14A:
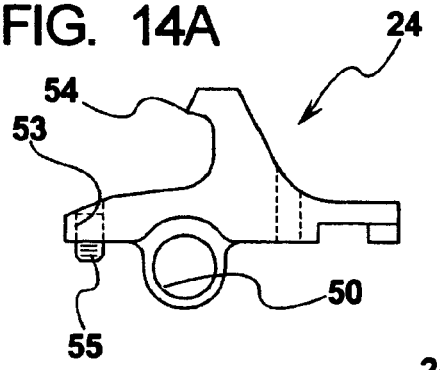
FIG. 14A shows a side view of the disconnector.
Figure 14B:
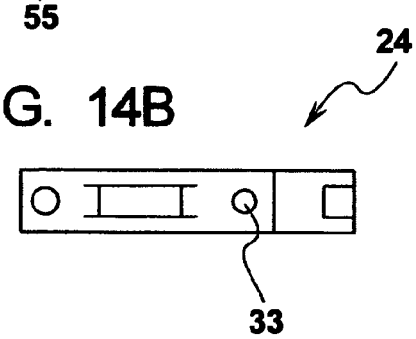
FIG. 14B shows a top view of the disconnector.
Figure 15:
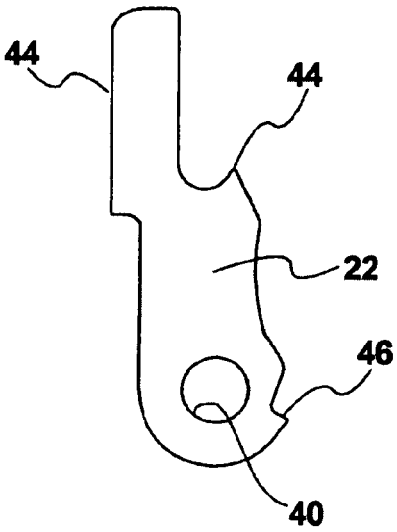
FIG. 15 shows a side view of the hammer.
Figure 16A:
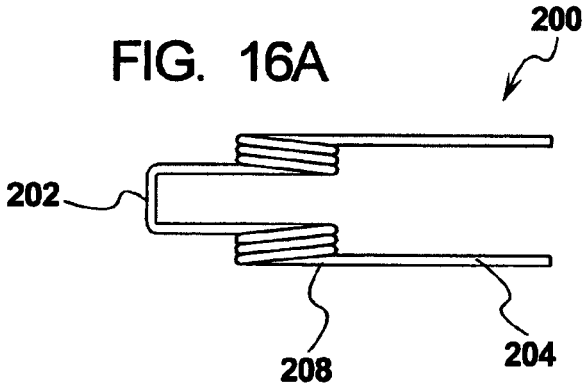
FIG. 16A shows a top view of the hammer spring.
Figure 16B:
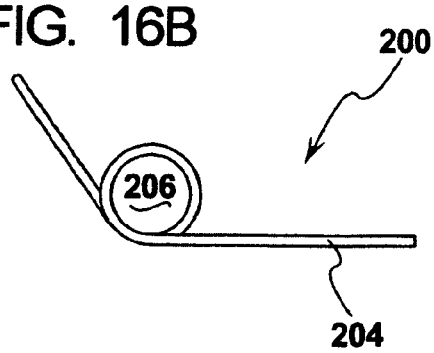
FIG. 16B shows a side view of the hammer spring which is adapted to put a moment upon the hammer and impart energy thereon.

Now referring to the lower left hand portion of FIG. 6, the trigger 26 comprises a trigger extension 70, a pivot region 72 (see FIG. 13A) and two general locations referred to as a longitudinally forward region 74 and a longitudinally rearward region 76. An upper surface 71 is positioned in the longitudinally forward region 74. Further, a second upper surface 73 is provided in the longitudinally rearward section 76. The surfaces 71 and 73 are adapted to engage the disconnector engagement adjustment system 51 and the biasing member 57 respectively as described above. Located in the longitudinally forward region 74 is a trigger over travel adjustment system 78 which in one form comprises an adjustment member such as a setscrew 80 having a lower surface 82. The adjustment member is adapted to limit the rotation of the trigger 28 in a first rotational direction 79 as shown in FIG. 6. The setscrew in one form is adapted to be positioned in a recessed that is located in the longitudinally forward region 74 of the trigger 26. The lower surface 82 is adapted to engage the longitudinally forward surface region 126 of the housing 28 described further herein below. The trigger over travel adjustment system 78 is adapted to adjust the rotational location of the trigger 26 about the pivot region 72.

Figure 12A:
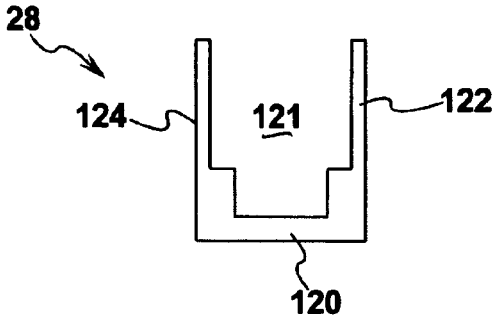
FIG. 12A shows a front view of the housing structure of the trigger assembly.
Figure 12B:
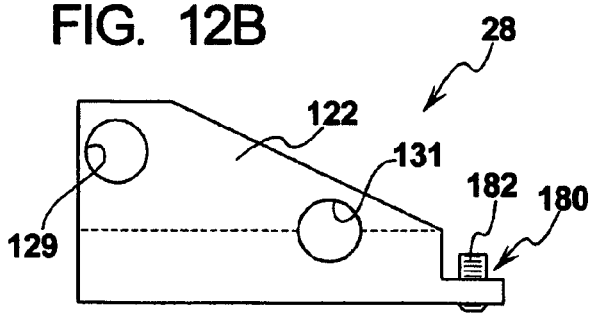
FIG. 12B shows a side view of the housing structure where the locking system is shown in the rearward portion and adapted to positively engage the lower receiver.
Figure 12C:
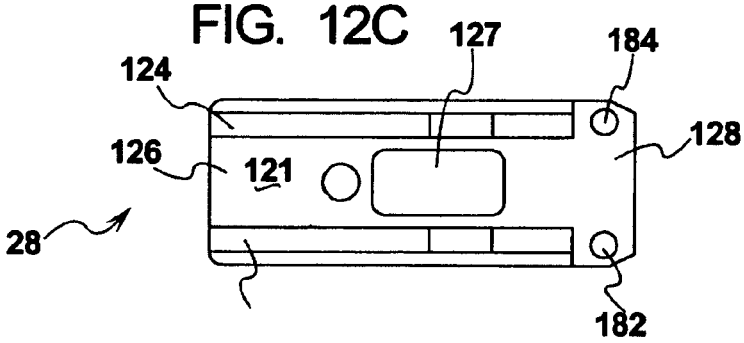
FIG. 12C shows a top view of the housing.
Figure 12D:
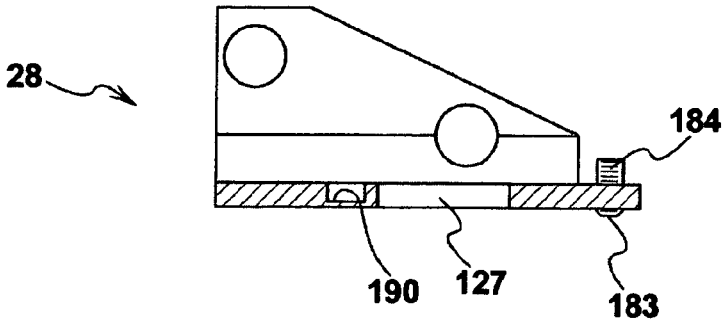
FIG. 12D shows a cross-sectional view taken in the lateral direction of the housing.

As further shown in FIG. 6, a trigger pull weight adjusting system 90 is positioned in the longitudinally forward region 74 of the trigger 26. The trigger pull weight adjustment system 90 in one form is a helical spring having a lower surface 92 which is adapted to engage recess 190 as best shown in FIG. 12D in the forward region of the housing 28. The operation of the trigger pull weight adjustment system 90 is to provide a clockwise moment (with reference to the orientation in FIG. 6) about the pivot region 72. The trigger pull weight adjustment system 90 has an adjustment portion 93 which in one form is a setscrew device that adjust the upper distance of the helical spring with respect to the distance of the longitudinally forward surface 126 of the housing 28 whereby adjusting the tension. Other words, given the spring constant of the helical spring, by altering the distance between the upper and lower extremities of the helical spring the force exerted therefrom is altered. This is particularly advantageous for the trigger weight must be adjusted for various competitions and safety purposes. Further, in one form the upper area 93 is at least partially exposed when the trigger assembly 20 is in an assembled state as shown in FIG. 2, whereby the adjustment can occur without disassembling or removing trigger assembly 20 from the lower receiver of the firearm. In this form the adjustment portion 93 is exposed and substantially unobstructed about transverse axis. The trigger pull weight adjustment system could be place in the lateral direction with respect to the sear 24 to provide access to the user. The trigger pull weight in general would be adjusted between 3.0 lbs. to 5 lbs. of trigger pull upon the trigger extension 70 in one form. Of course the pull weight is contingent upon the coefficient of friction between the sear surfaces 46 and 56 of the hammer-trigger sear system 42 as well.

As further shown in FIG. 6, now referring to the longitudinally rearward section 76 of the trigger 26, a trigger take up adjustment system 96 is provided where in one form, it is implemented by a adjustment member such as a setscrew 98 having a lower surface 100 that is adapted to engage the longitudinally rearward upper surface region 128 of the housing 28. In general, the trigger take up adjustment system 96 limits the amount of rotation of the trigger 28 in a second rotational direction 97 shown in FIG. 6. By limiting the rotation in the second direction 97 inherently limits the amount of sear engagement of the sear surfaces 46 and 56. The setscrew 98 is adapted to be received in a threaded recess region 102 that is located in the longitudinally rearward section 76 of the trigger 26. The operation of the trigger take up adjustment system 96 works as follows. As the distance between the longitudinally rearward section 76 and the longitudinally rearward surface 128 of the housing 28 is separated from one another, the hammer-trigger sear system 42 will have less engagement surface between surfaces 46 and 56 whereby creating less take up of the trigger. In general a very crisp trigger will have about 25 thousands of an inch engagement (in the transverse direction). In this scenario only 0.025 of an inch travel of movement is required to release the hammer at a finger pressure point on the trigger extension 70 that is at the approximate distance from the center of the pivot region 72 as the engagement of the sear surfaces 46 and 56. As described further herein following the discussion of the housing 28 and the safety adjustment system, the sear surface engagement distance of sear surfaces 46 and 56 can be substantially reduced given the combination of various adjustment features.

Figure 8:
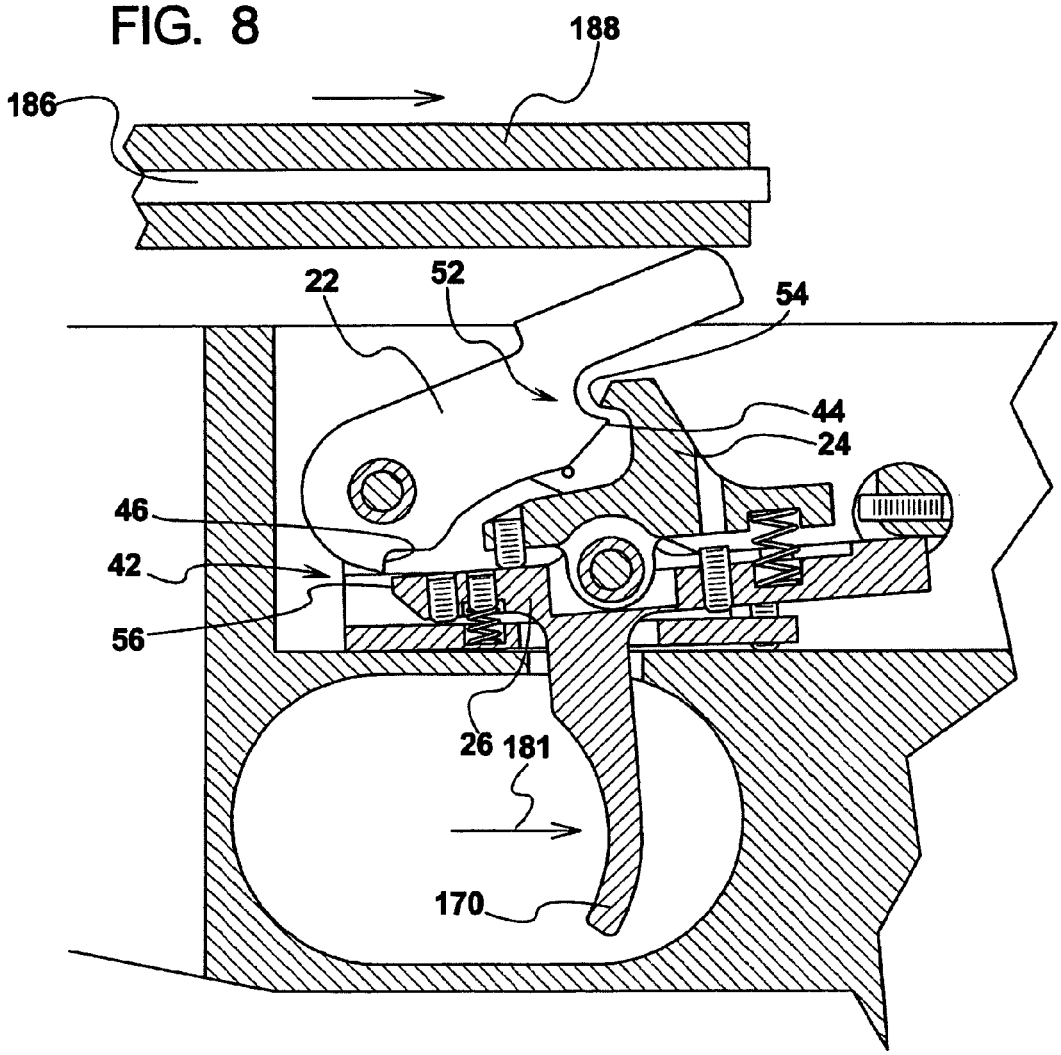
FIG. 8 illustrates the carriage assembly traveling rearwardly propelled by a portion of the energy of the discharging bullet in one form by way of a return gas tube.
Figure 9:
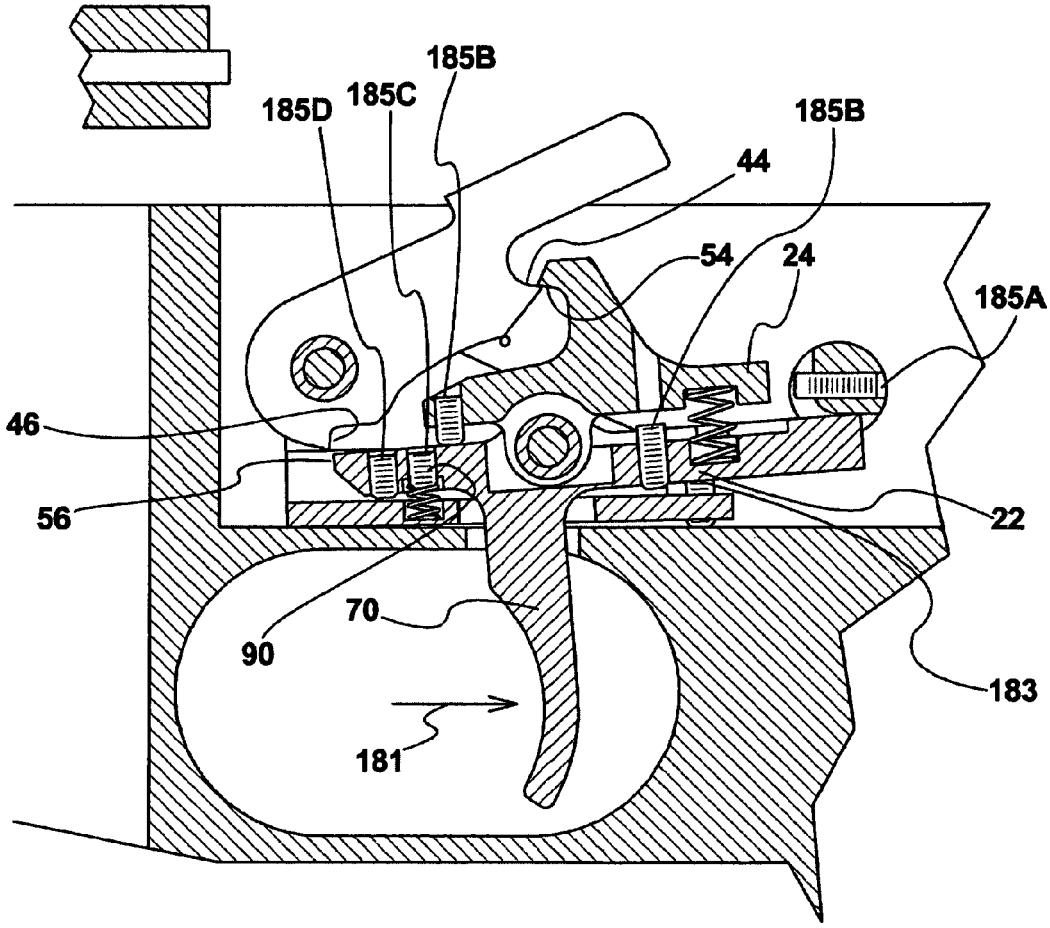
FIG. 9 illustrates one state of the system where rearward pull is maintained upon the trigger and the disconnector is adapted to position the trigger in a rearward position without the hammer unintentionally falling.
Figure 10:
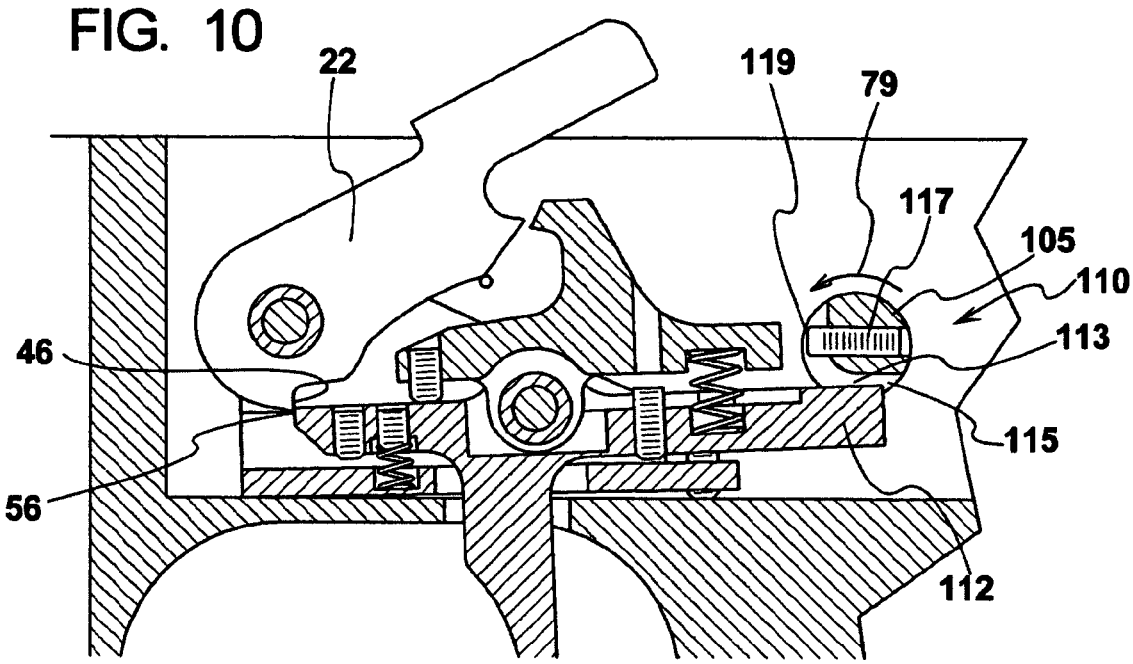
FIG. 10 illustrates the trigger rotating forwardly and the sear surfaces between the trigger and hammer maintain the trigger in a rearward high potential energy state where in the right-hand portion of this figure the safety mechanism is shown to be rotated to a position illustrated in FIG. 11.

The trigger 26 further comprises a safety adjustment system 110 as shown in the right hand portion of FIG. 10. The safety adjustment system 110 is positioned on the safety 105. In essence, the trigger tail 112 of the trigger 26 extends longitudinally rearwardly and the upper surface 114 is adapted to engage the recessed portion 115 and the setscrew 117 of the safety adjustment system 110 to be an operable mode (FIGS. 4-10) and a safe mode (FIG. 11) respectively. In general, the safety 105 has a laterally extending member 107 (see FIG. 2) that is partially cylindrical central section with a parallel to the center of the axis of the cylinder but offset to one side to provide a recessed portion 115. When the portion 115 as shown in FIG. 10 is exposed to the trigger tail 112 as shown in FIGS. 4-10, the firearm is in the fire mode where the safety is off. When the adjustment surface 119 of the set screw 117 is exposed and substantial orthogonal to the upper surface (safety engagement surface) 113 of the trigger tail 112 the trigger cannot travel in a counter clockwise motion to release the hammer release sear system whereby the gun is unable to be fired by pressing the trigger extension 70.

Normally, the tolerances of the safety vary from firearm to firearm. The tolerance stack up of various assembled parts can lead to a dangerous situation where safeties do not function properly and a rounded portion in prior art safeties that are in the proximate location of surface 119 of FIG. 11 do not engage surface 113 allowing the trigger 26 to rotate and perhaps disengage sear surfaces 46 and 56 from one-another causing a the firearm to fire. Further, operators employed with an AR-15, or the equivalent, often rely upon the safety to determine if their rifle is chambered (or at least determine if the hammer 22 is cocked). As shown in FIG. 7, if the hammer 22 is down as shown in this figure, the cylindrical surface 41 of the hammer 22 engages the upper surface 61 of the forward region 74 of the trigger 26 near the trigger sear surface 56. As the safety 105 is rotated to a safe position (counter clockwise in FIG. 7), the surface 119 engages upper surface 113 of the trigger tail 112. This causes a clockwise rotation of the trigger 26; however, the engagement of surfaces 41 and 61 prevents substantial rotational motion of the trigger 26 and the safety 105. The rotation is not sufficient to allow the safety to be in the safe position (as in FIG. 11) when the hammer 22 is down as in FIG. 7. This method is a relatively quite way and does not require repositioning the hands form a shooting hand orientation to determine if the hammer is cocked (and presumably determine if there is a round in the chamber if proper loading protocol is performed).

In one form, the safety adjustment system 110 comprises a setscrew 117 where the effective surface is adjusted in the transverse direction to properly engage the upper surface 113 without having an excessive interference it where the safety cannot rotate about its center axis and properly engage the trigger tail 112 to place the firearm in a safe condition. Therefore, adjusting the surface 119 in the direction 116 as shown in FIG. 7 can properly adjust the safety to have the "snug" fit between the surface 113 of the trigger tail 112 and the surface 119 of the safety 105. The surface 119, as with any of the surfaces of the various set screws, can be the surface of a setscrew or the upper surface of some sort of interposed covering such as a metallic ban which engages the safety.

In FIG. 4, the hammer 22, sear disconnector 24 and trigger 26 are hereby defined as the upper trigger configuration 21. The upper trigger configuration 21 is adapted to fit in the central chamber region 121 having an unobstructed upper open area (see FIG. 12A) of the housing 28 described below.

Referring to FIGS. 12A-12D, the housing 28 comprises a base area 120 and first lateral wall 122 and a second lateral wall 124. The base area 120 comprises a forward longitudinal surface 126 and a rearward longitudinal surface and a central open region 127 is adapted to allow the trigger extension 70 to pass therethrough when in an assembled state. The surfaces 126 and 128 are adapted to engage the lower transverse surfaces 82 and 100 of the setscrews 80 and 98 respectively (see FIG. 4). Further, the lower surface 92 of the biasing member 191 is adapted to engage the longitudinally forward surface 126. In essence, the surfaces 126 and 128 provide a foundation for the adjustment system is described above and this foundation can be set at the factory or other certified personnel's control and the gun owner with the receiver does not need to adjust the trigger assembly other than the safety adjustment system 110 and the locking system 180 described further below.

The lateral walls 122 and 124 provide surfaces for openings 129 and 131 which are adapted to receive the outer cylindrical surface of the first and second centrally open pins 150 and 152 as shown in FIG. 4.

Figure 3:
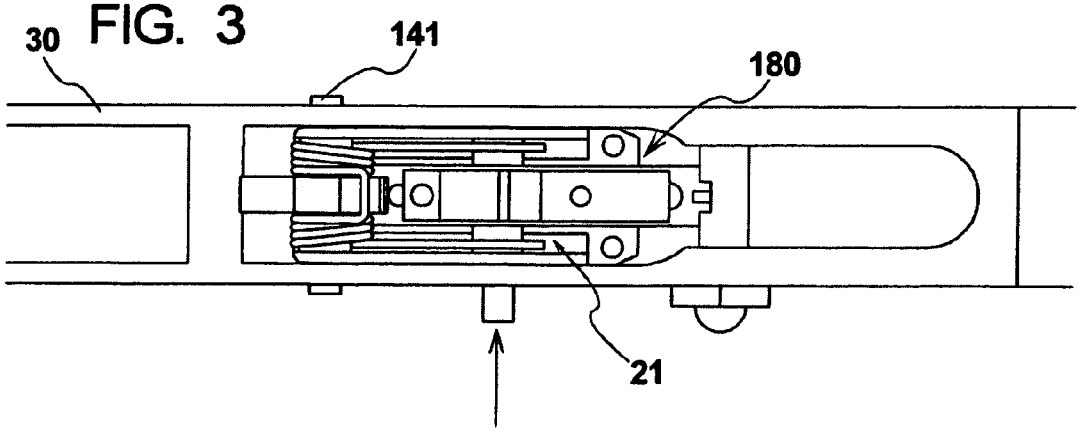
FIG. 3 shows the top view of the trigger assembly mounted to the lower receiver where the laterally extending pins are retaining the trigger assembly in a central chamber region of the lower receiver.

It should be noted one that the laterally extending pins 140 and 142 as shown in FIGS. 2 and 3 can be pins that already exist with the lower receiver. These pins are generally at one of two different diameters depending on the particular model of firearm. The inner diameters 154 and 156 of the first and second centrally open pins 150 and 152 can be changed for the proper engagement of the pins 152 and 154. The trigger assembly 20 allows a substantially unobstructed throughput channel through the entire trigger assembly so these pins 152 and 154 can extend therethrough and essentially locking the trigger assembly therein the chamber region of the lower receiver 30.

Figure 2A:
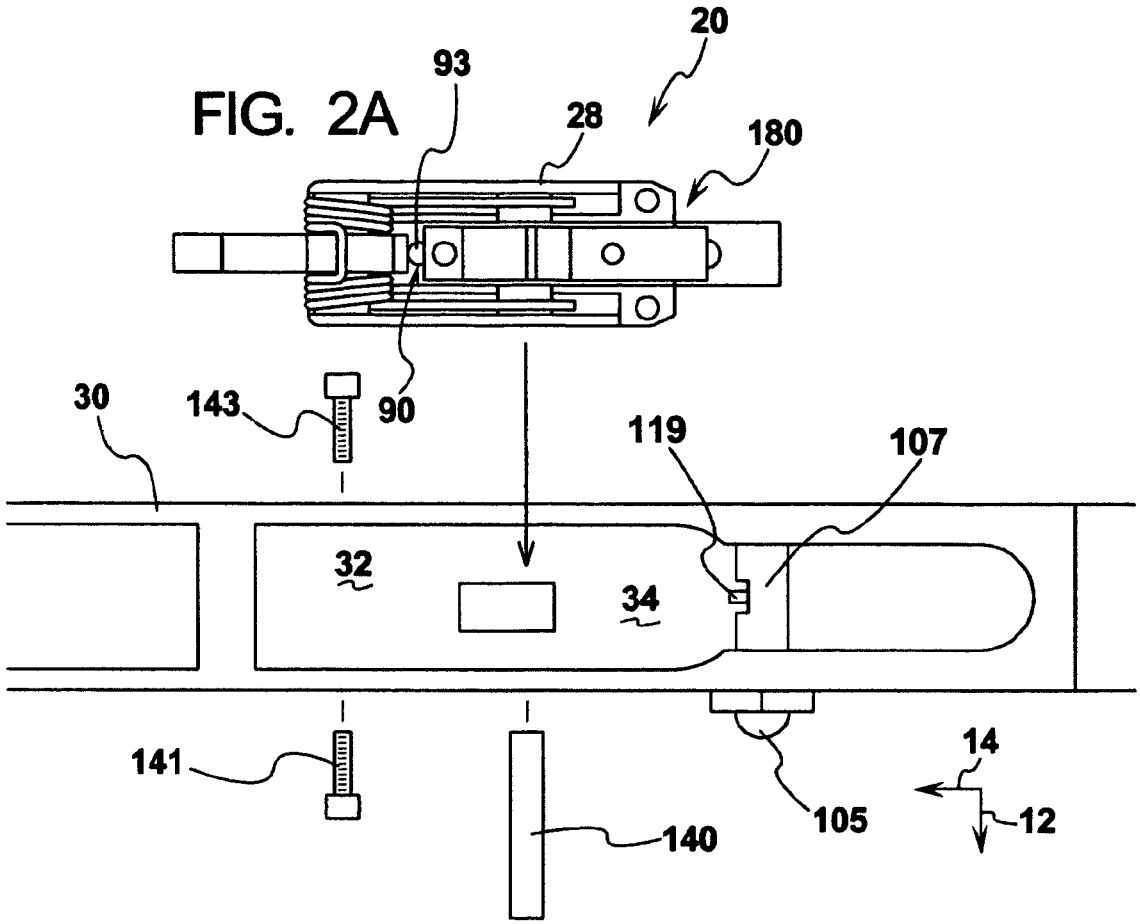
FIGS. 2A and 3A are similar to FIGS. 2 and 3; however, laterally extending screws are adapted to mount the trigger assembly to the lower receiver.
Figure 3A:
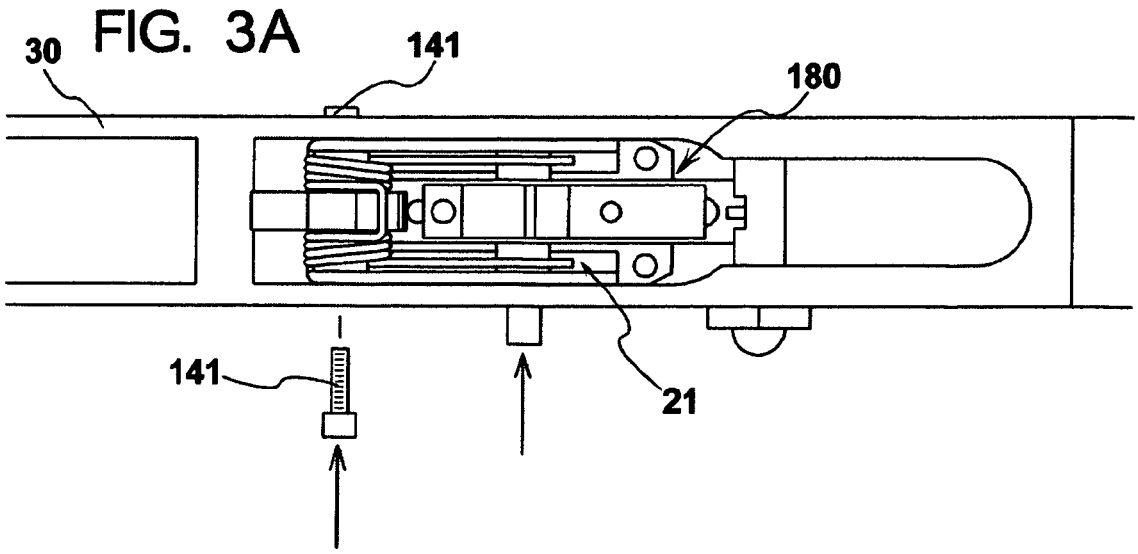

FIGS. 2A and 3A show an alternate configuration where set screws 141 and 143 are employed. In this embodiment the set screws 141 and 143 area adapted to engage a threaded interior surface of the second centrally open pin 152. The set screws 141 and 143 are adapted to assist lock the housing 28 in place with respect to the lower receiver 30.

To properly hold the trigger assembly in a proper orientation first and second centrally open pins 150 and 152 are provided which have an inside diameter 154 and 156 that is adapted to allow the pins 140 and 142 to pass therethrough respectively. The lateral lengths of the pins 150 and 152 respectively are approximately the substantial same width of the lateral distance of the housing 28 (see lower middle portion of FIG. 2 where the centrally open pins are housed within the housing 28). It should be noted that the pins 140 and 142 extend further in the lateral direction as best shown in FIG. 3 and are adapted to engage the openings 168 and 170 of the lower receiver as shown in FIG. 1.

It should further be noted that the approximate distance between the openings 168 and 170 of the lower receiver may be somewhat varied depending on manufacture and quality of the parts. Therefore, the inside diameters 154 and 156 of the centrally open pins 150 and 152 in one form can be somewhat larger than the outside diameter of the first and second mounting pins 140 and 142. Or alternatively, one of the inside diameters 154 or 156 may be larger to account for potential "slop" where the various center to center distances between the openings 168 and 170 of the lower receiver (see FIG. 1A) may differ. Therefore, to accommodate for the potential dimensional inconsistencies which may occur in retrofitting the triggers which has been found to be as much as 25 thousands of an inch, as shown in FIG. 1, an locking system 180 is provided where in one form the locking system 180 has an extendible member such as a pair of set screws 182 and 184 (see FIG. 12B) where the upper head regions 183 as shown in FIG. 9 are unobstructed from the upper trigger configuration 21 to provide access by the installer after the pins 140 and 142 secure the trigger assembly 22 lower receiver (see FIG. 3). In essence, the locking system 180 would engage the trigger assembly 20 with respect to the lower surface 34 of the central chamber area 32 of the lower receiver 30 (see FIG. 1). This would in essence tightening the trigger assembly 20 to the lower receiver and prevent the trigger assembly 20 from rattling around and the chamber area 32. Any movement of the entire trigger assembly 20 is extremely undesirable to the discriminating shooter. The trigger assembly as shown in the various figures is a single stage trigger. A single stage trigger allows for a crisp trigger break with minimum "creep"/take up (which is adjusted by the trigger take up adjustment system 96 as described in FIG. 6) and minimum over travel (which is adjusted by the trigger over travel adjustment system 78 also shown in FIG. 6). It can be appreciated that the motion of the trigger 26 should be a crisp motion with respect to the firearm. By adding an addition movement issue of allowing the housing 28 to move with respect to the lower receiver would provide inconsistent trigger pull and further allow repositioning of the trigger tail 112 which has adverse effects of proper adjustment of the safety 105.

Figure 21:
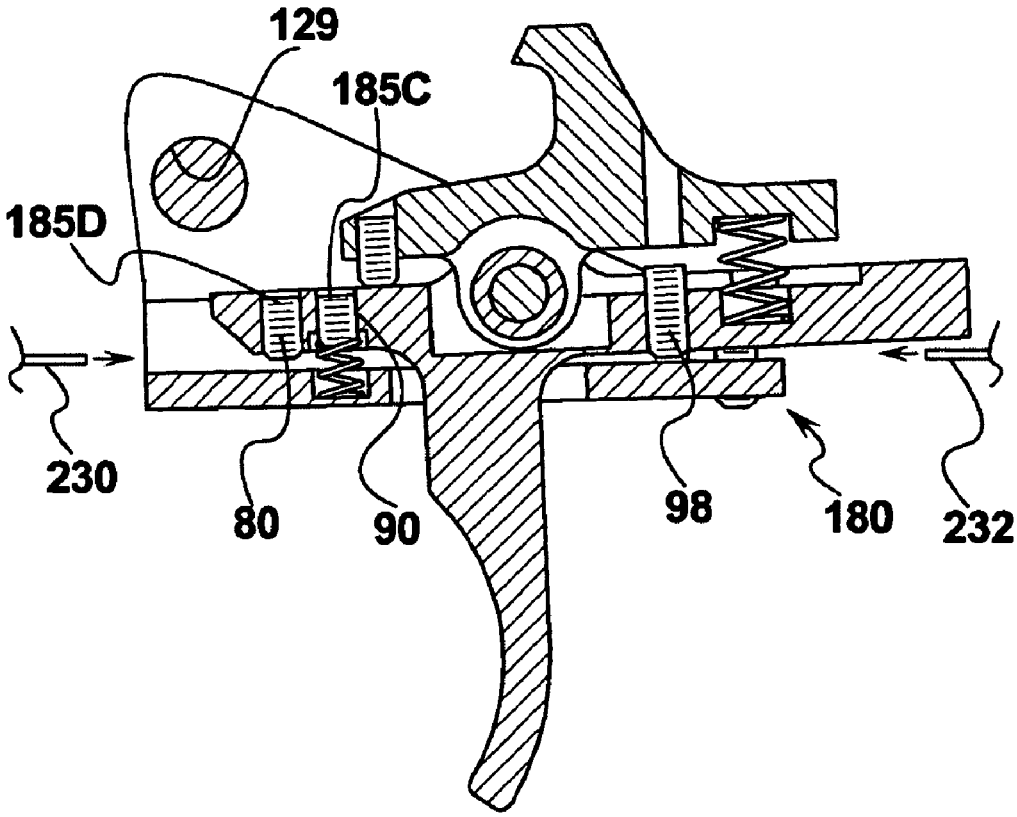
FIG. 21 shows a method of assembling the trigger components using shims to properly space the trigger with respect to the housing.

It should be further noted in FIG. 9 that upper head regions 185 of the various adjustment members that in the preferred form are screws are accessible from the vertical position of the trigger assembly. Further, the upper head region 185A of the safety adjustment system is additionally adjustable from the upper vertical location of the firearm. However, in one form the upper head regions 185B have an adhesive material fixedly mounting the various adjustment members after they have been properly adjusted. In other words in one form it is desirable to have a trained professional adjust the various set screws and only allow the rifle owner to adjust the locking system 180 and the safety adjustment system 105 which do not affect the sear relationships of the trigger over travel adjustment system and the trigger take up adjustment system as well as the disconnector sear system. The adjustment head 185C of the trigger pull weigh system 90 can be left available to the user for adjustment of the counter torque in the second direction. It should be noted that the adjustment of the head 185D can be a factory adjustment where as shown in FIG. 21 the a shims 230 and 232 is temporarily interposed at the forward and rearward regions at alternative times where the adjustment heads of the set screws 98 and 80 are properly adjusted for the trigger take up and overtravel. Thereafter the hammer can be installed in the region of the opening 129.

In one form the inner diameter of the second centrally open pin 152 tightly engages the laterally extending pin 142. The second centrally open pin 152 thereby establishes a reference point which is advantageous for properly positioning the firing pin engagement surface 39 of the hammer 22 with respect to firing pin 186 when the carriage assembly 188 is in a forward and locked position (see FIG. 4). In some embodiments this precise orientation is important where it is desired to have the firing pin engagement surface 39 properly orientated in an orthogonal manner with respects to the firing pin 186 of the carriage assembly 188. The inner diameter 154 of the first centrally open pin 150 would be greater than the diameter 156 to account for variances in the center to center distances of the openings 168 and 170 and possible diameter variances of the same (see FIG. 1). The locking system 180 would then reposition the housing 28 so the outer surface of the laterally extending pin 140 would forcefully engage the interior surface of the first centrally open pin 150, presumably in the transverse lower portion thereof.

It should be noted that the hammer spring is provided which biases the hammer in a direction toward the firing pin. A conventional hammer spring can be employed, or alternatively, a different type of hammer spring can be employed which is described below.

Figure 11:
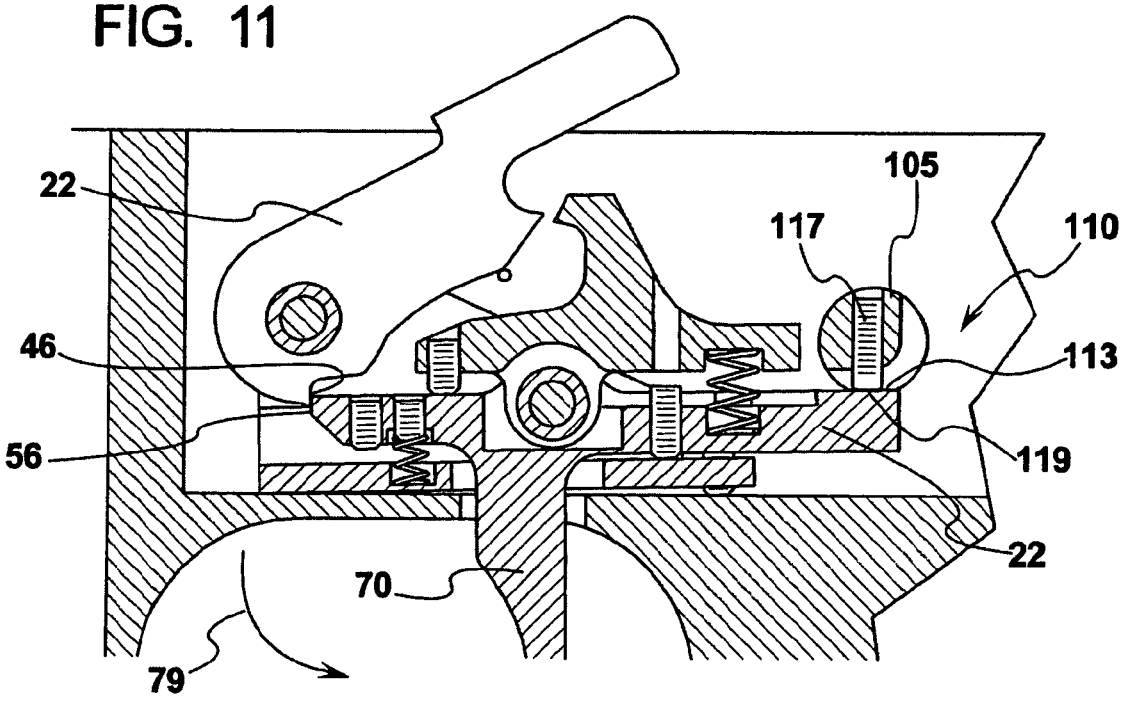
FIG. 11 shows the safety mechanism engaging the trigger tail so the trigger can not be repositioned rearwardly and rotate in a first direction to discharge around.

Fixedly positioning the housing 28 is further advantageous when the safety system 105 as shown in FIG. 7 should be properly adjusted after the insertion of the trigger assembly 20. In general, the adjustment surface 119 of the safety 105 is adapted to engage the safety engagement surface 113 of the trigger tail 112. Therefore, in an orientation of the safety where it is in a safe position as shown in FIG. 11, the surfaces 113 and 119 are in proximal engagement so when force applied to the trigger extension 70 the entire trigger unit 22 will not rotate in the first direction indicated by arrow 79. In some form, there is a mild amount of forceful engagement between the surfaces 119 and 113 to ensure the trigger 22 does not rotate and allow the sear surfaces 46 and 56 to disengage dropping the hammer 22. Further, the safety system should be adjusted so when the trigger assembly is in a low potential energy state where the hammer is down as shown in FIG. 4, the surfaces 41 and 61 of the hammer and trigger engage one another so if the safety 105 is attempted to be rotated in a counterclockwise manner as shown in FIG. 4, it is not possible to obtain an orientation such as that as shown in FIG. 11. This orientation is not possible because the surfaces 113 and 119 are essentially too proximal to one another to allow for the full 90 degree counterclockwise rotation of the safety 105. As mentioned above, this is a desirable feature where the operator of the firearm can check if the hammer 22 is down as shown in FIG. 4 by simply attempting to rotate the safety 105 (see FIG. 1) to a safe position, and if resistance is met, the hammer is down.

There will now be brief discussion of the operation of the firearm with reference to FIGS. 4-11.

As shown in FIG. 4, the hammer 22 is "down" in a low potential energy state where the hammer engagement portion 202 is biasing the hammer 22 in this longitudinally forward position against the firing pin 186. As shown in FIG. 5, the carriage assembly 188 is repositioned rearwardly presumably by a charging handle which is operated manually by the shooter. The lower portion of the carriage assembly 188 engages the firing pin engagement surface 39 to put a counterclockwise movement upon the hammer 22 and position it rearwardly. As shown in FIG. 6, the carriage assembly 188 is positioned forwardly and presumably locks the bold to the barrel of the gun. As shown in this figure, the sear surfaces 46 and 56 are in engagement and a slight amount of counterclockwise motion of the trigger 22 (rotation in a first direction 79) releases the disengagement of the surfaces 46 and 56 and the hammer 22 "drops" and is biased in the first direction 79 by the hammer engagement region 202 of the hammer spring (not fully shown in FIG. 7). The firing pin engagement surface strikes the rearward portion of the firing pin 186, which in turn strikes the primer, and the firearm discharges a round. In a gas-operated (or in some forms a piston-operated) semiautomatic firearm such as an AR-15, the carriage assembly 188 is propelled rearwardly as shown in FIG. 8. If the force vector 181 as shown in FIG. 7 is maintained upon the trigger extension 70, then without the disconnector 24 present, the hammer 22 would simply follow the carriage assembly 188 because it is not possible for the sear surfaces 46 and 56 to engage one another. If the hammer 22 were to follow the carriage assembly 88 and may cause an accidental or unwanted discharge of the second loaded round and place the firearm in an uncontrolled full auto operation. Alternately, the hammer 22 would follow the carriage assembly 188 in a manner where not enough energy is applied to the firing pin 186 and the firearm is not able to fire unless the charging handle attracts the carriage assembly rearwardly which would of course eject a live round. Therefore, configuration of the disconnector sear system 52 as described above referring to FIG. 4 is important. Referring to FIG. 9, when the force upon the trigger indicated by the force vector 181 is released, as the surfaces 44 and 54 disengage, by rotation of the disconnector 24 and the trigger 22, the sear surfaces 46 and 56 have tangential overlap and become in engagement as shown in FIG. 10.

As further shown in FIG. 10 as well as FIG. 11, in this orientation the safety 105 can rotate in the first direction indicated at arrow 79A of FIG. 10 to an orientation such as that as shown in FIG. 11.

FIGS. 17-20 show another embodiment of the safety 105*a*. In general, the safety 105*a* is an optional ambidextrous-type safety which can be used on the left, right or on both sides of the firearm. In certain situations, a rifle must be fired from the shooter's weak side where in a situation such as a three-gun competition the shooter may have to load the rifle, position it on his left (weak) shoulder, and disengage the safety with his left thumb on the right-hand portion of the lower receiver. An ambidexterous safety can be employed, which would cut time in this situation.

Figure 17:
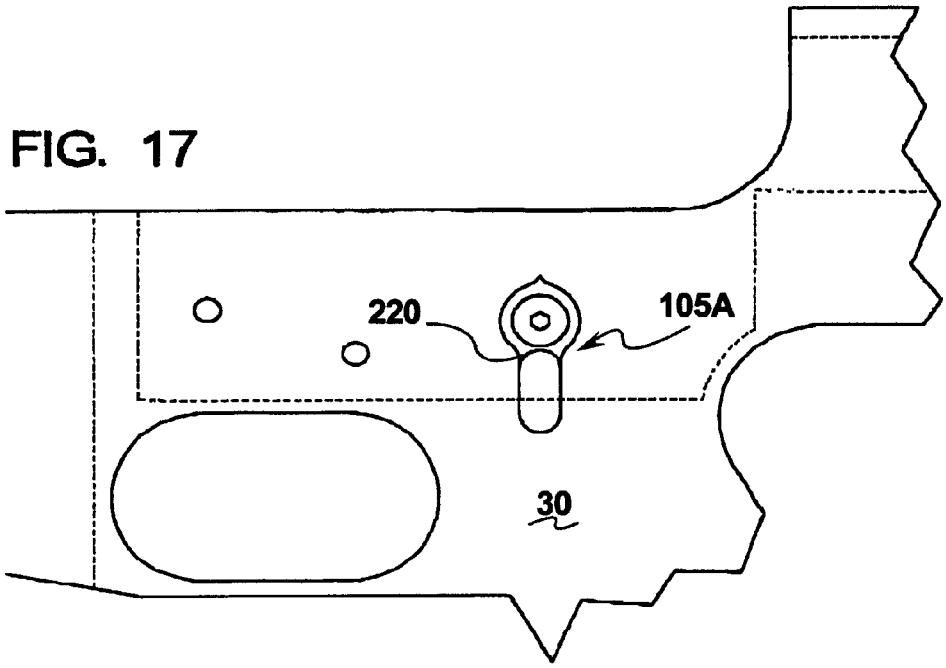
FIG. 17 shows an ambidextrous safety embodiment along the lateral axis direction.
Figure 18:
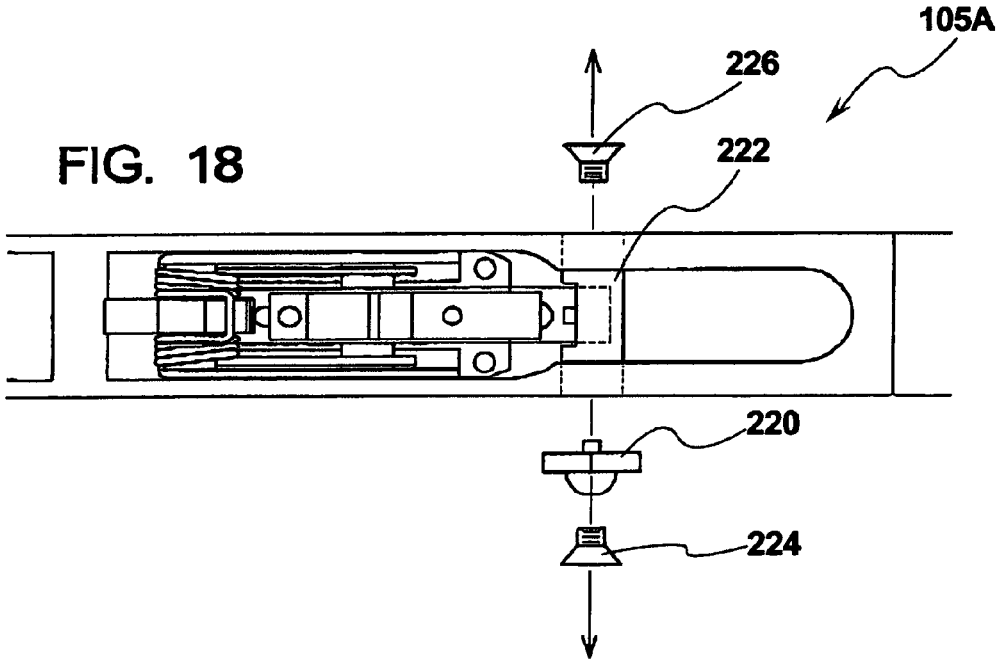
FIG. 18 shows a top view of one arrangement of the safety lever.
Figure 19:
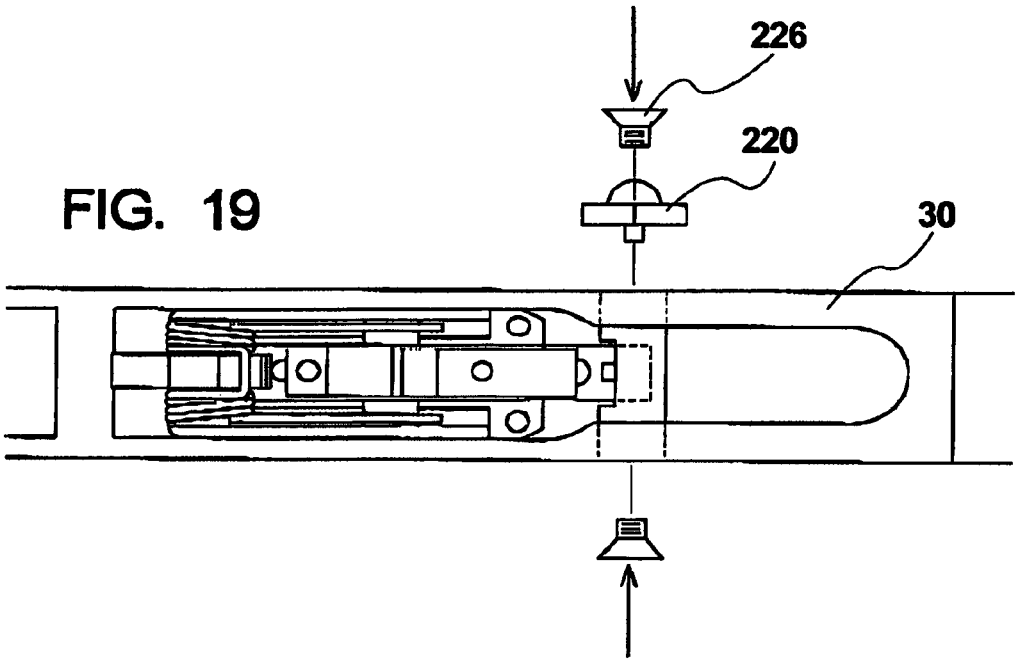
FIG. 19 shows a second arrangement of the safety lever positioned on the opposing lateral side of the firearm.
Figure 20:
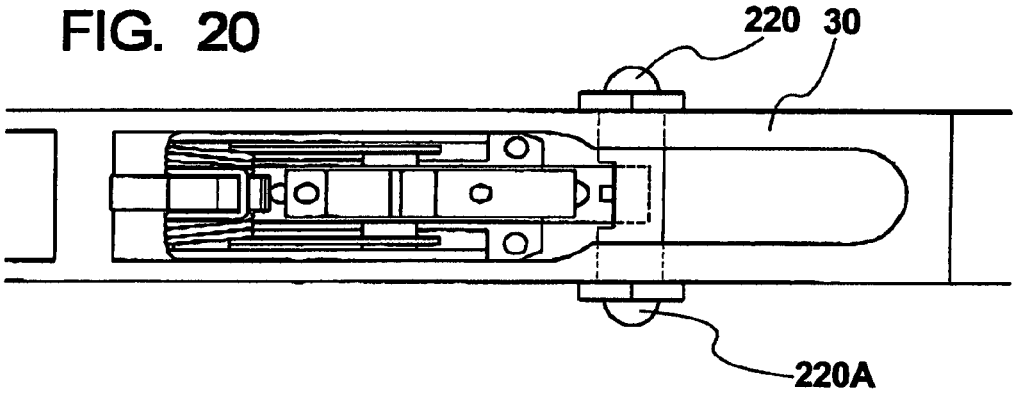
FIG. 20 shows yet another arrangement where two levers are employed on either side of the firearm.

As shown in FIG. 17, the safety 105*a* comprises a safety lever 220. As shown in FIG. 18, the central elongate portion 222 of the safety 105*a* has lateral portions that are adapted to threadedly engage the first and second fasteners 224 and 226. As shown in FIG. 19, the lever 220 can further be attached on the opposing side of the lower receiver 30. Further, as shown in FIG. 20, the safety levers 220 and 220*a* can both be employed where the operation of the safety can be conducted by the shooter on either side of the firearm.

Of course a variety of mechanisms can be employed to produce the results of the present mechanism without departing from the basic teachings thereof.

I claim:

1. A trigger assembly adapted to be fitted to the lower receiver of a firearm having a central chamber region having a lower surface, the trigger assembly comprising:

a) a housing having a forward and rearward regions and first and second lateral walls and a base portion providing an upper surface, b) a locking system having an extendable member that is adapted to engage the lower receiver to minimize movement between the housing and the lower receiver, c) a hammer pivotally connected to the housing in the forward region of the housing, the hammer having a hammer disconnector sear surface, d) a trigger pivotally connected to the housing, the trigger having a trigger sear surface located in a forward region, e) a trigger over travel adjustment system having an adjustment member with a lower surface adapted to engage the upper surface of the housing to limit the range of rotational travel of the trigger in a first rotational direction, f) a trigger take up adjustment system having an adjustment member with a lower surface that is adapted to engage the upper surface of the housing to limit the amount of rotation of the trigger in a second rotational direction, the trigger further having a safety engagement surface, g) a safety system comprising a laterally extending member and an adjustable member having an adjustment surface that is adapted to reposition with respect to the laterally extending member, the adjustment surface adapted to engage the safety engagement surface of the trigger to limit rotation in the first rotational direction when the safety system is activated.

2. The trigger assembly as recited in claim 1 where the adjustment members of the trigger over travel adjustment system and the trigger take up adjustment system are comprised of set screws threadedly engaged to the trigger.

3. The trigger assembly as recited in claim 2 where the set screws are accessible from a central chamber region positioned between the first and second lateral walls of the housing and having an unobstructed upper open area adapted to allow access for adjustment of the set screws of the trigger over travel adjustment system and the trigger take up adjustment system.

4. The trigger assembly as recited in claim 3 where an adhesive material fixedly mounts the head region of the set screws of the trigger over travel adjustment system and the trigger take up adjustment system to the trigger to prevent further adjustment of the trigger over travel adjustment system and the trigger take up adjustment system.

5. The trigger assembly as recited in claim 1 where the extendable member of the locking system comprises first and second set screws threadedly engaged to the housing and the first and second set screws having an upper head region that is unobstructed and accessible when the trigger assembly is positioned within the central chamber region of the lower receiver.

6. The trigger assembly as recited in claim 1 where the safety system comprises a lever that is positioned on the exterior of the lower receiver of the firearm and adapted to rotate the laterally extending member from a safe position to a fire position.

7. The trigger assembly as recited in claim 6 where the lever is removably and fixedly attached to the laterally extending member of the safety system.

8. The trigger assembly as recited in claim 7 where the lever is removably and fixedly attached to the laterally extending member of the safety system and adapted to be attached to either the left or right lateral location of the laterally extending member.

9. The trigger assembly as recited in claim 1 where the trigger and hammer are pivotally connected to the housing by first and second centrally open pins where first and second mounting pins are adapted to pass through openings in the receiver and through first and second centrally open pins to mount the trigger assembly to the receiver.

10. The trigger assembly as recited in claim 9 where the first and second centrally open pins have a diameter that is larger than the diameter of the first and second mounting pins to account for potential out of tolerance issues with the openings in the receiver.

11. The trigger assembly as recited in claim 9 where the first and second centrally open pins have a diameter that is larger than the diameter of the first and second mounting pins where the locking system is adapted to restrict movement of the housing with respect to the lower receiver.

12. The trigger assembly as recited in claim 9 where a sear is mounted to the first centrally open pin and a sear adjustment system is adapted to adjust the amount of sear engagement between a hammer engagement sear surface positioned on the hammer and an engagement sear surface positioned on the sear.

13. A trigger assembly adapted to be fitted to a firearm having a central chamber region having a lower surface, the trigger assembly comprising:

a) a housing having a forward and rearward regions and first and second lateral walls and a base portion providing an upper surface, b) a locking system adapted to engage the firearm to minimize movement between the housing and the firearm, c) a hammer pivotally connected to the housing in the forward region of the housing, the hammer having a hammer disconnector sear surface, d) a trigger pivotally connected to the housing, the trigger having a trigger sear surface located in a forward region, e) a trigger over travel adjustment system having an adjustment member adjustably connected to the trigger, the adjustment member having a lower surface adapted to engage the upper surface of the housing to limit the range of rotational travel of the trigger in a first rotational direction, f) a trigger take up adjustment system having an adjustment member with a lower surface and adjustably connected to the trigger, that is adapted to engage the upper surface of the housing to limit the amount of rotation of the trigger in a second rotational direction, g) whereas the adjustment member of the trigger take up adjustment system are reasonably accessible for adjustment when the trigger and hammer are actively assembled to the housing.

14. The trigger assembly as recited in claim 13 where the locking system comprises an extendable member of the locking system comprises first and second set screws threadedly engaged to the housing and the first and second set screws having an upper head region that is unobstructed and accessible when the trigger assembly is positioned within the central chamber region of the firearm.

15. The trigger assembly as recited in claim 13 where the trigger take up adjustment system is adapted to position the engagement of the trigger sear surface and the hammer disconnector sear surface of the hammer to be less than 0.035 inches.

* * * * *

UNITED STATES PATENT AND TRADEMARK OFFICE
Certificate

Patent No. 7,421,937 B1 Patented: September 9, 2008

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: John Gangl, Hugo, MN (US); and Tim Ubl, Darwin, MN (US).

Signed and Sealed this Twenty-eighth Day of September 2010.

MICHAEL J. CARONE
*Supervisory Patent Examiner*
Art Unit 3641
Technology Center 3600